United States Patent [19]

Buck

[11] 4,283,606

[45] Aug. 11, 1981

[54] COAXIAL LOUDSPEAKER SYSTEM

[75] Inventor: Marshall D. Buck, Los Angeles, Calif.

[73] Assignee: Cerwin Vega, Inc., Arlea, Calif.

[21] Appl. No.: 57,821

[22] Filed: Jul. 16, 1979

[51] Int. Cl.[3] ..... H04R 7/00; H04R 9/06

[52] U.S. Cl. ..... 179/115.5 H; 179/116; 181/144; 181/166; 181/184

[58] Field of Search ..... 181/157, 160, 161, 163, 181/166, 181–185, 187, 188, 189, 196, 295, 144, 148, 155, 156; 179/115.5 R, 115.5 PC, 115.5 VC, 115.5 H, 116

[56] References Cited

U.S. PATENT DOCUMENTS

| | | | |
|---|---|---|---|
| 2,067,582 | 1/1937 | Sperling | 181/157 |
| 2,295,527 | 9/1942 | Bowley | 181/144 |
| 2,656,004 | 10/1953 | Olson | 181/295 |
| 2,822,884 | 2/1958 | Simpson | 181/156 |
| 2,840,178 | 6/1958 | Boleslav | 181/155 |
| 2,866,514 | 12/1958 | Weathers | 181/151 |
| 3,284,581 | 11/1966 | Fender | 179/115.5 VC |
| 4,182,429 | 1/1980 | Senzaki | 181/144 |

*Primary Examiner*—L. T. Hix
*Assistant Examiner*—Benjamin R. Fuller
*Attorney, Agent, or Firm*—W. Edward Johansen

[57] ABSTRACT

The present invention is an acoustic filter for use in combination with a coaxial loudspeaker system which includes a low frequency loudspeaker and a high frequency speaker which is axially aligned with the low frequency loudspeaker. The acoustic filter includes a pair of parallel, perforated sheets which are separated from each other a suitable distance and which are joined together at their peripheries in any appropriate manner so that they enclose an airspace therebetween in order to form a single section filter. The acoustic filter is disposed between the low frequency loudspeaker and the high frequency loudspeaker so the acoustic filter inhibits the high frequency sounds of the high frequency loudspeaker from interacting with the internal sidewall of the conically shaped diaphragm of the low frequency loudspeaker.

8 Claims, 11 Drawing Figures

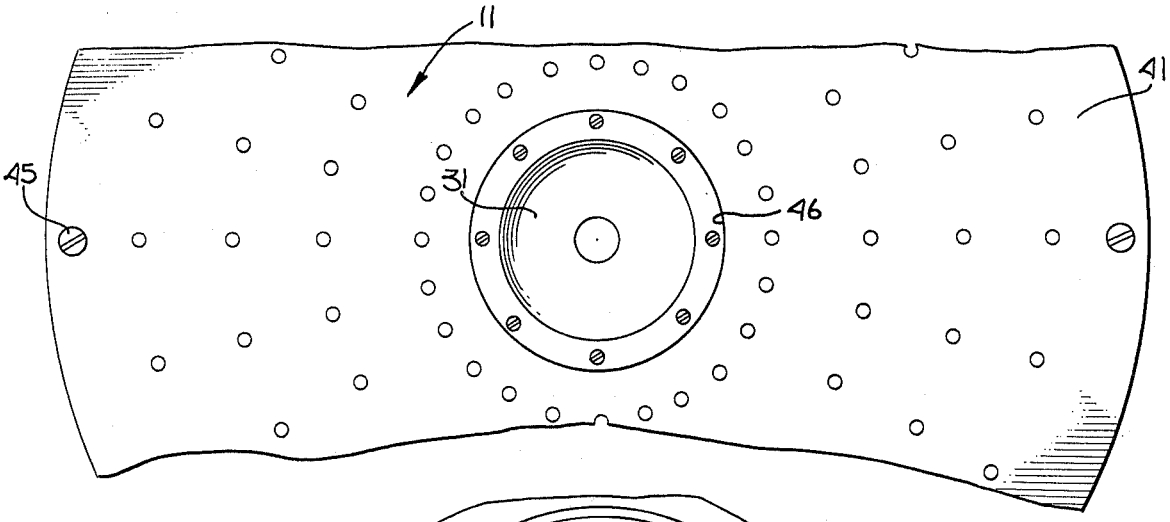
Fig. 3
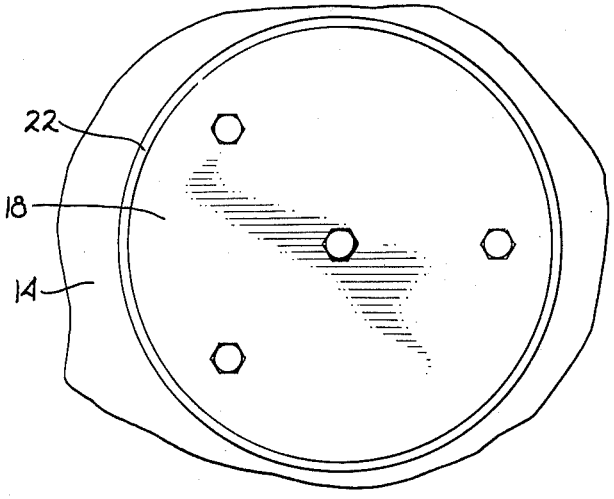
Fig. 4
Fig. 6
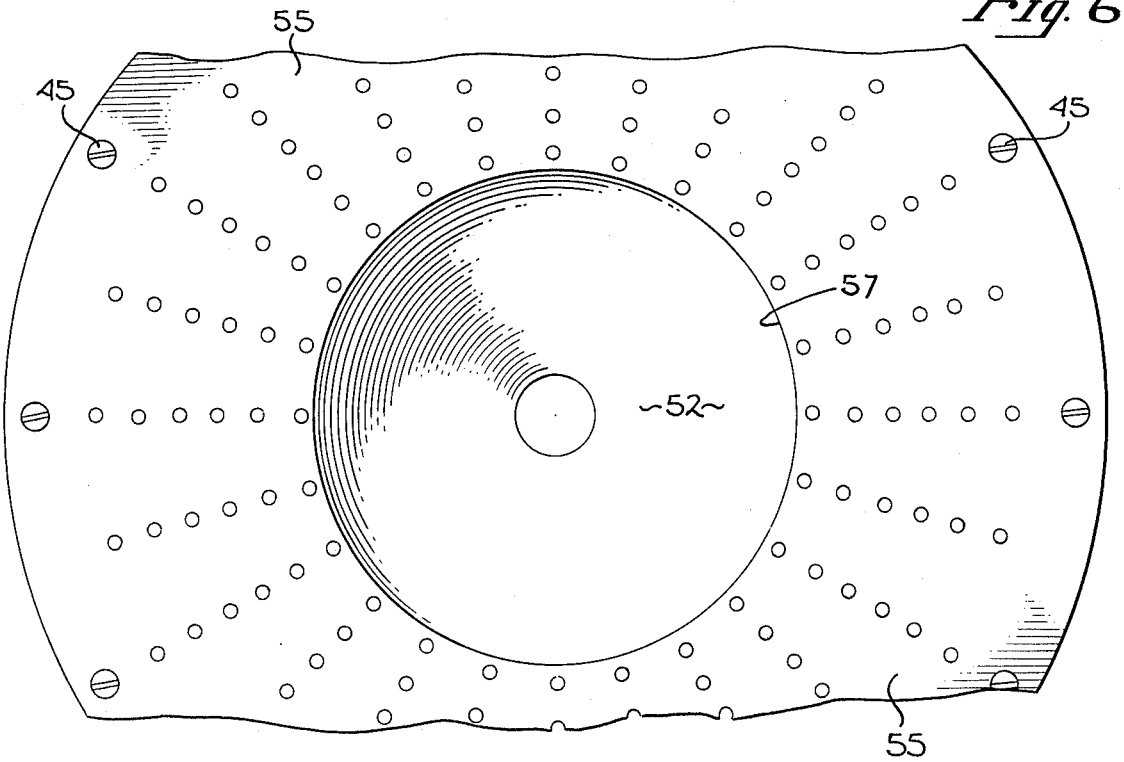

Fig. 7
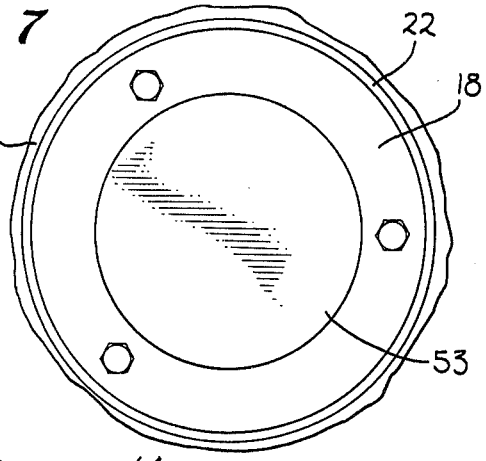
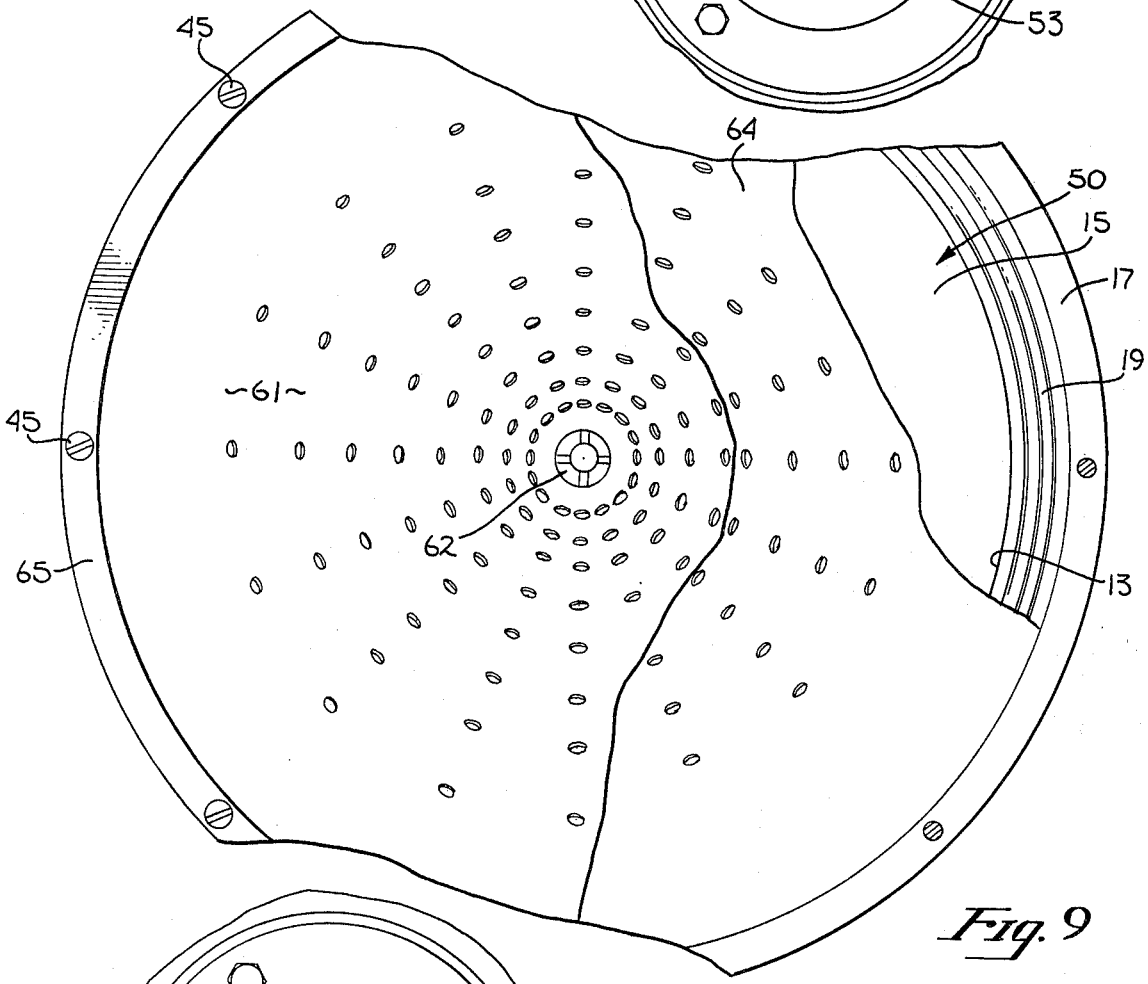
Fig. 9
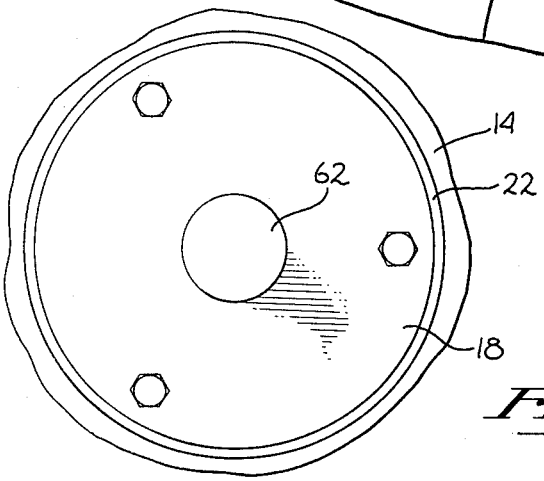
Fig. 10

COAXIAL LOUDSPEAKER SYSTEM

BACKGROUND OF THE INVENTION

1. Field of the Invention

The present invention relates to a coaxial loudspeaker and more particularly to a coaxial loudspeaker which incorporates an acoustic low pass filter therein to eliminate distortion.

2. Description of the Prior Art

U.S. Pat. No. 2,822,884, entitled Loudspeaker Enclosure, issued to Edgar H. Simpson on Feb. 11, 1958, teaches a single speaker cabinet with two acoustic filters and a single speaker. U.S. Pat. No. 2,866,514, entitled, Corrective Loud Speaker Enclosure, issued to Paul Weathers, on Dec. 30, 1958, teaches a single speaker enclosure with a plurality of chambers which are acoustically coupled to the speaker chamber by acoustic filters.

U.S. Pat. No. 2,067,582, entitled Sound Filter for Loudspeakers, issued to Edward Sperling on Jan. 12, 1937, teaches a sound filter used with only one loudspeaker. The sound filter, when it is applied to the loudspeaker, functions to filter and to clarify the sounds and tones emitted therefrom by minimizing harshness, distortion, static or interference while serving to generally improve the quality of the sounds or tones.

U.S. Pat. No. 2,656,004, entitled Multisection Acoustic Filter, issued to Harry F. Olson on Oct. 20, 1953, teaches a multisection acoustic filter which consists of one or more stages or sections. Each section includes a pair of parallel, perforated sheets or plates separated from each other a suitable distance and joined at their peripheries in any appropriate manner to enclose an air space therebetween. Two such plates constitute a single section filter. A two section filter consists of three such plates, one being common to each section; a three section filter consists of four such plates. These filters may be placed in front of any sound source, such as the loudspeaker of a radio receiver, for example, or in proximity to one or more musical instruments or the like to reduce the high frequency response in each case.

A two-way loudspeaker system is a very practical solution to the problem of building a transducer array that will cover the full audio frequency range. The coaxial arrangement, where the low frequencies are reproduced by a cone loudspeaker of a diameter in the range of twelve to fifteen inches (called a woofer) and the high frequencies are reproduced by a small cone or horn transducer (called a tweeter) mounted in front of the larger cone, provides advantages over the spaced woofer-tweeter arrangement in regards to producing an even distribution of sound at angles other than directly on axis. This is due to the closer spacing of the radiating elements. A further advantage in the smoothness of frequency response can be obtained if the tweeter horn is disposed so that it projects through the center pole piece of the low frequency transducer, with the horn continuing forward approximately to the plane of the rim of the woofer. In this configuration the acoustic centers of the two transducers can be arranged to superimpose each other at their crossover frequency by adding a small amount of electrical time delay in the woofer electrical crossover network. The superimposition of the acoustic centers of the two transducers is verified by acoustical phase measurements. The coaxial configuration however, as typically found in commercial loudspeakers has a problem with intermodulation distortion.

The audible distortion of the high frequencies radiated by the tweeter is caused by the Doppler shift as these high frequencies are reflected off the moving cone surface of the low frequency woofer.

Paul W. Klipsch, in an article entitled "A Note on Modulation Distortion: Coaxial and Spaced Tweeter-Woofer Loudspeaker System", published in the *Journal of the Audio Engineering Society,* Volume 24, Number 3, April, 1976 on pages 186 and 187, discusses the FM distortion of two loudspeaker systems, one of which has a tweeter mounted coaxially with the woofer, and the other has a spaced tweeter-woofer configuration. A loudspeaker radiating high frequencies in close proximity to a loudspeaker radiating low frequencies is observed to be subject to modulation distortion. Thus a tweeter being fed $f_2=9559$ Hz in proximity to a bass speaker radiating $f_1=50$ Hz was found to radiate side frequencies of 9609, 9509, 9659 ($f_2 \pm f_1$, $f_2 \pm 2f_1$, . . . ). The sound from the tweeter diffracts around the horn and is reflected by the moving woofer cone, thus producing FM distortion. Klipsch found that clearly audible FM (frequency modulation) distortion of the $f_2$ component of 9559 Hertz was produced by a 50 Hertz, $f_1$, signal of 95 db, sound pressure level in the coaxial arrangement. The total root mean square modulation distortion was 27 decibels below the level of $f_2$. The magnitude of the distortion components which are generated in this manner is determined by the following equation:

$$d=0.033A_1f_2k,$$

where d = total root mean square value of the distortion sidebands as a percent of the amplitude of the higher modulated frequency, $f_2$, and $A_1$ = peak amplitude of motion in inches at the lower modulating frequency, $f_1$, and k = the proportion of high frequency sound which is radiated to the rear of the tweeter and reflected off the moving low frequency cone.

For example, if $A_1=0.25$ inches, $f=5000$ Hertz, $k=0.1$, which is minus twenty decibels, the distortion, d, is 4.1 percent, which is −27.7 db. This degree of distortion would be clearly audible.

A. Stott and P. E. Axon, in their article entitled, "The Subjective Discrimination of Pitch and Amplitude Fluctuations in Recording Systems", published in the *Journal of the Audio Engineering Society,* Volume Five, Number 3, July, 1957 beginning on page 142, discusses the threshold of audibility of frequency modulation distortion of recorded piano program material. Referring to their FIG. 10, it can be verified that 0.4% RMS FM distortion by 30 Hz is the audible FM distortion threshold, of this musical material.

In a conventional coaxial speaker a portion of the high frequency sound from the horn is radiated toward the cone, which is moving and which reflects the high frequency sound, thereby creating a Doppler intermodulation-distortion. An acoustic low pass filter, if it is placed between the horn and the cone, will attenuate the high frequency sound traveling from the horn to the cone and from the cone to the environment thereby dramatically reducing the Doppler intermodulation-distortion.

As an example, if an acoustic filter of the full section type, which has a cutoff frequency of 2500 Hertz, is fitted between the tweeter and woofer, at 5000 Hertz, the factor k in the example cited above would be reduced by approximately forty decibels (40 db) to 0.001, and the distortion would also be reduced by forty decibels, to 0.041 percent. This degree of distortion would be approximately 20 db below audibility. A full section filter attenuates as much as twenty decibels at one octave above the cutoff frequency and the k factor includes two passes through the filter thereby providing the forty decibel reduction as calculated.

This distortion reduction afforded by such a filter increases as the frequency $f_2$ increases. Without an acoustic filter the distortion increases in a manner directly proportional to the frequency radiated by the tweeter.

Furthermore, the low pass filter attenuates the harmonic distortion components which are emanating from the cone at frequencies above the cutoff frequency of the acoustic filter which in a typical application is designed to be at the same frequency as the electrical cross-over between the woofer and the tweeter loudspeakers.

SUMMARY OF THE INVENTION

In view of the foregoing factors and conditions characteristic of the prior art, it is the primary object of the present invention to either eliminate or attenuate an objectionable form of distortion which is inherent in coaxial loudspeaker systems of the prior art.

It is another object of the present invention to provide for a relatively large horn for a high frequency, through-the-bore coaxial loudspeaker, tweeter, while allowing low frequency sounds from a low frequency loudspeaker, woofer, to pass unimpeded through the entire horn of the high frequency loudspeaker which functions as a full section low pass acoustic filter.

In accordance with an embodiment of the present invention an acoustic filter for use in combination with a coaxial loudspeaker system which includes a low frequency loudspeaker and a high frequency speaker which is disposed acoustically in front of the low frequency loudspeaker is described. The acoustic filter includes a pair of parallel, perforated sheets which are separated from each other a suitable distance and which are joined together at their peripheries in any appropriate manner so that they enclose an airspace therebetween in order to form a single section filter. The acoustic filter is disposed between the low frequency loudspeaker and the high frequency loudspeaker so the acoustic filter inhibits the high frequency sounds of the high frequency loudspeaker from interacting with the internal sidewall of the conically shaped diaphragm of the low frequency loudspeaker.

The features of the present invention which are believed to be novel are set forth with particularity in the appended claims.

Other objects and many of the attendant advantages will be more readily appreciated as the same becomes better understood by reference to the following detailed description and considered in connection with the accompanying drawing in which like reference symbols designate like parts throughout the figures.

DESCRIPTION OF THE DRAWING

FIG. 3 is a partial top plan view of the coaxial loudspeaker system of FIG. 1 illustrating the acoustic filter thereof.

FIG. 4 is a partial bottom plan view of the coaxial loudspeaker of FIG. 1.

FIG. 6 is a partial top plan view of the coaxial loudspeaker of FIG. 5.

FIG. 7 is a partial bottom view of the coaxial loudspeaker of FIG. 5.

FIG. 9 is a partial, staggered top cross-sectional view of the coaxial loudspeaker of FIG. 8.

FIG. 10 is a partial bottom plan view of the coaxial loudspeaker of FIG. 8.

DESCRIPTION OF THE PREFERRED EMBODIMENT

Figure 1:
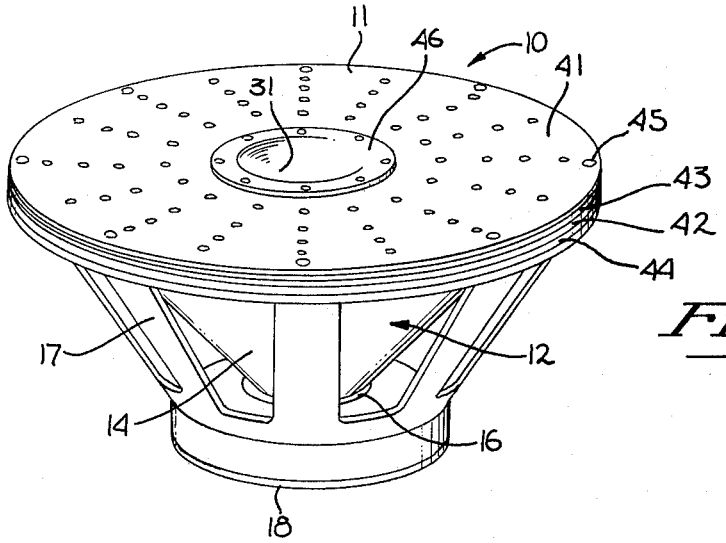
FIG. 1 is a perspective drawing of a coaxial loudspeaker system which incorporates a first embodiment of an acoustic filter which is constructed in accordance with the principles of the present invention.

The present invention can be best understood by reference to a description of its preferred embodiment and to the showings in the drawing. Referring to FIG. 1 in conjunction with FIG. 2 a coaxial loudspeaker system includes a low frequency loudspeaker 10 which uses an improved acoustic filter 11 in combination therewith. The low frequency loudspeaker 10 includes a conically shaped diaphragm 12 having a front peripheral edge 13, an external sidewall 14, an internal sidewall 15 and a base peripheral edge 16 and a frame 17 having a conically shaped portion adapted to receive the diaphragm 12 and a back plate 18. The low frequency loudspeaker 10 also includes a surround 19 which mechanically couples the front peripheral edge 13 of the diaphragm 12 to the frame 17.

Figure 2:
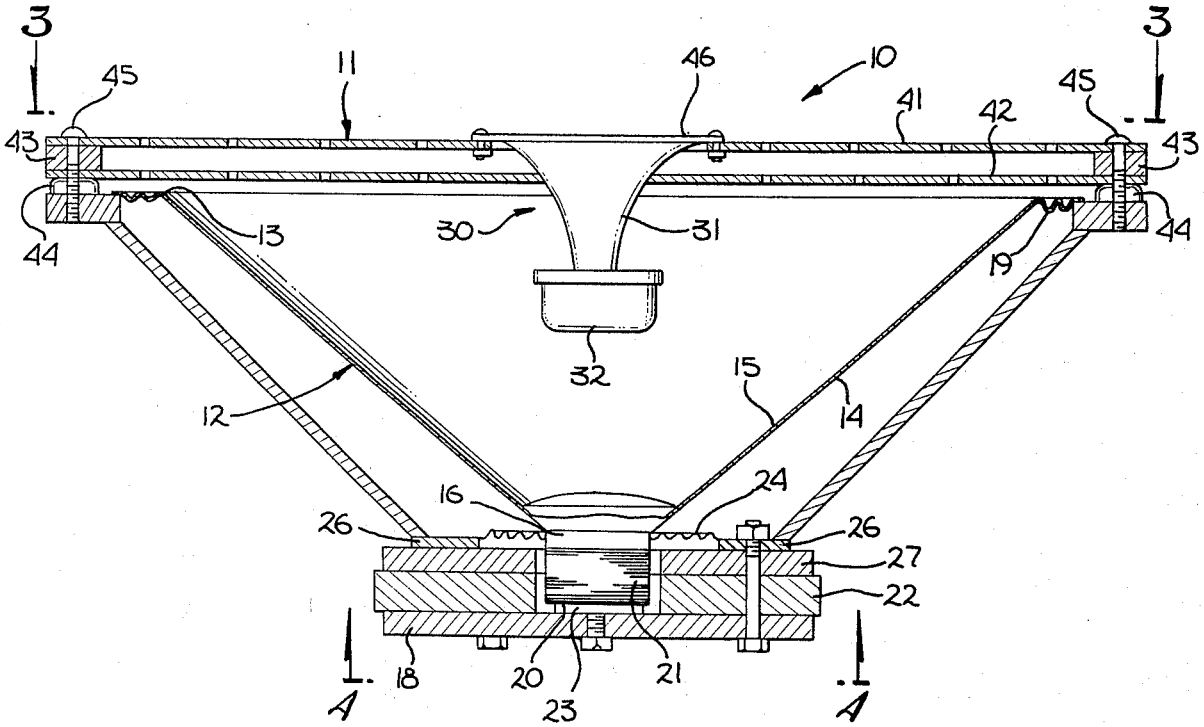
FIG. 2 is an elevational cross-sectional view of the coaxial loudspeaker system of FIG. 1.

Referring still to FIG. 2 the low frequency loudspeaker 10 further includes a cylindrically shaped voice coil member 20 which is mechanically coupled to the base peripheral edge 16 of the diaphragm 12, a voice coil 21 disposed about the voice coil member 20, a ring-shaped magnet 22, and a front plate 27 which are disposed about the voice coil 21 and which are mechanically coupled to the back plate 18, and a cylindrical iron pole piece 23 which is disposed within the voice coil member 20 and which is also mechanically coupled to the back plate 18. The ring-shaped magnet 22, the front plate 27 and the pole piece 23 create a magnetic gap across the voice coil 21.

Still yet referring to FIG. 2 the low frequency loudspeaker 10 still further includes a centering spider 24 which mechanically couples the base peripheral edge 16 of the diaphragm 12 to the base portion 26 of the frame 17. The centering spider 24 centers the voice coil 21 within the magnetic gap.

The coaxial loudspeaker system also has a high frequency loudspeaker 30 which includes a horn 31 and the transducer element 32 and circuitry for electronically directing the high frequency signals to the high frequency loudspeaker 30 and the low frequency signals to the low frequency loudspeaker 10 in order to provide a smooth crossover between them. The high frequency loudspeaker 30 is disposed in front of the low frequency loudspeaker 10 and axially aligned therewith.

Referring to FIG. 1 and FIG. 2 in conjunction with FIG. 3 the improved acoustic filter 11 includes a first perforated sheet 41, a second perforated sheet 42, which is parallelly disposed to the first perforated sheet 41 and separated apart therefrom a suitable distance by a first spacer 43, and a second spacer 44 which separates the second perforated sheet 42 from the peripheral edge of the frame 17. A set of screws 45 secures the first and second perforated sheets 41 and 42 and the first and second spacers 43 and 44 to the frame 17 in order to enclose the airspace between the first and second perforated sheets 41 and 42 and to maintain the second perforated sheet 42 apart from the front peripheral edge 13 of the conically shaped diaphragm 12, the peripheral edge of the frame 17 and the centering spider 24. The improved acoustic filter 11 has an opening 46 for the high frequency loudspeaker 30 and is placed between the low frequency loudspeaker 10 and the high frequency loudspeaker 30, which is mechanically coupled thereto in order to either eliminate or inhibit the high frequency sounds from the high frequency loudspeaker 30 from interacting with the inner sidewall 15 of the conically shaped diaphragm 12 of the low frequency loudspeaker 10 and thereby creating a Doppler shift in frequency which results in the distortion of the high frequency sounds.

Referring to FIG. 4 in conjunction with FIG. 2 the back plate 18 of the low frequency loudspeaker 10 is more clearly seen.

Figure 5:
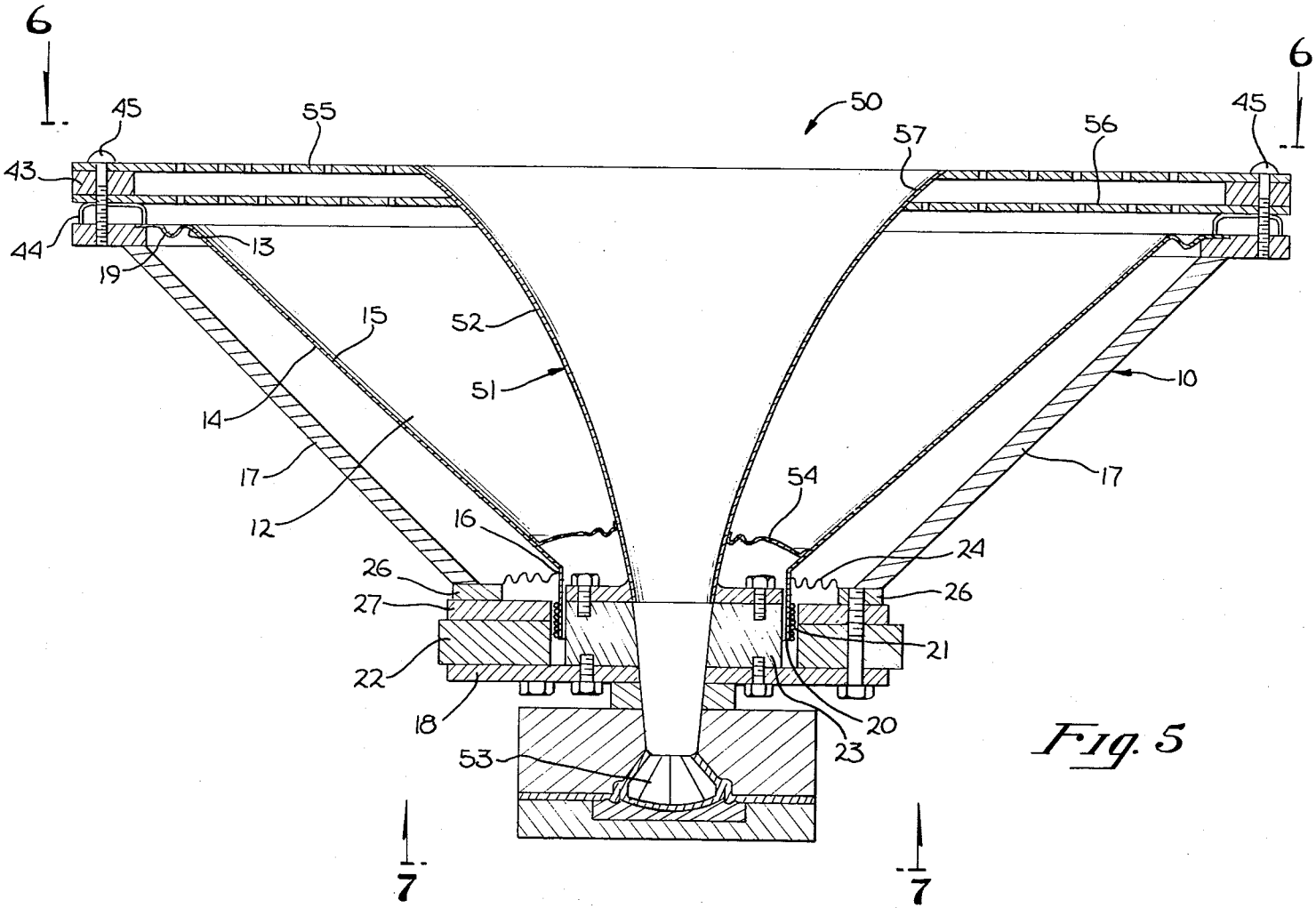
FIG. 5 is an elevational cross-sectional view of a coaxial loudspeaker system which incorporates a second acoustic filter which is constructed in accordance with the principles of the present invention.

Referring now to FIG. 5 in conjunction with FIG. 6 a second embodiment of the present invention is an acoustic filter for use in combination with another coaxial loudspeaker system which includes a low frequency loudspeaker 50 and a high frequency loudspeaker. The low frequency loudspeaker 50 includes a conically shaped diaphragm 12 having a front peripheral edge 13, an external sidewall 14, an internal sidewall 15 and a base peripheral edge 16 and a frame 17 having a conically shaped portion adapted to receive the diaphragm 12 and a back plate 18. The low frequency loudspeaker 50 also includes a surround 19 which mechanically couples the front peripheral edge 13 of the diaphragm 12 to the frame 17.

Referring still to FIG. 5 the low frequency loudspeaker 50 further includes a cylindrically shaped voice coil member 20 which is mechanically coupled to the base peripheral edge 16 of the diaphragm 12, a voice coil 21 disposed about the voice coil member 20, a ring-shaped magnet 22, a front plate 27, which are disposed about the voice coil 21 and which are mechanically coupled to the back plate 18, and a cylindrical iron pole piece 23 which is disposed within the voice coil member 20 and which is also mechanically coupled to the back plate 18. The ring-shaped magnet 22, a front plate 27, and the pole piece 23 create a magnetic gap across the voice coil 21.

Still yet referring to FIG. 5 the low frequency loudspeaker 50 still further includes a centering spider 24 which mechanically couples the base peripheral edge 16 of the diaphragm 12 to the base portion 26 of the frame 17. The centering spider 24 centers the voice coil 21 within the magnetic gap.

The coaxial loudspeaker system also has a high frequency loudspeaker 51 which includes a horn 52 and a transducer element 53 and circuitry for electronically directing the high frequency signals to the high frequency loudspeaker and the low frequency signals to the low frequency loudspeaker 50 in order to provide a smooth crossover between them. The high frequency loudspeaker 51 is disposed in front of the low frequency loudspeaker 50 and axially aligned therewith and its transducer element 53 is mechanically coupled to the pole piece 23 of the low frequency loudspeaker 50. The low frequency loudspeaker 50 also includes a centering spider 54 which mechanically couples the diaphragm 12 of the low frequency loudspeaker 50 to the horn 52 of the high frequency loudspeaker 51.

Referring again to FIG. 5 in conjunction with FIG. 6 the improved acoustic filter includes a first perforated sheet 55, a second perforated sheet 56, which is parallelly disposed to the first perforated sheet 55 and separated apart therefrom a suitable distance by a first spacer 43, and a second spacer 44 which separates the second perforated sheet 56 from the peripheral edge of the frame 17. A set of screws 45 secures the first and second perforated sheets 55 and 56 and the first and second spacers 43 and 44 to the frame 17 in order to enclose the airspace between the first and second perforated sheets 55 and 56 and to maintain the second perforated sheet 56 apart from the front peripheral edge 13 of the conically shaped diaphragm 12, the peripheral edge of the frame 17 and the surround 19. The improved acoustic filter has an opening 57 for the high frequency loudspeaker 51. The improved acoustic filter is placed between the low frequency loudspeaker 50 and the high frequency loudspeaker 51, which is mechanically coupled to the low frequency loudspeaker 50 through the pole piece 23 thereof, in order to either eliminate or inhibit the high frequency signals from the high frequency loudspeaker 51 from interacting with the internal sidewall 15 of the conically shaped diaphragm 12 of the low frequency loudspeaker 50 thereby creating a Doppler shift in frequency which results in the distortion of the high frequency sounds.

Referring to FIG. 7 in conjunction with FIG. 5 the back plate 18 of the low frequency loudspeaker 50 is more clearly seen.

Figure 8:
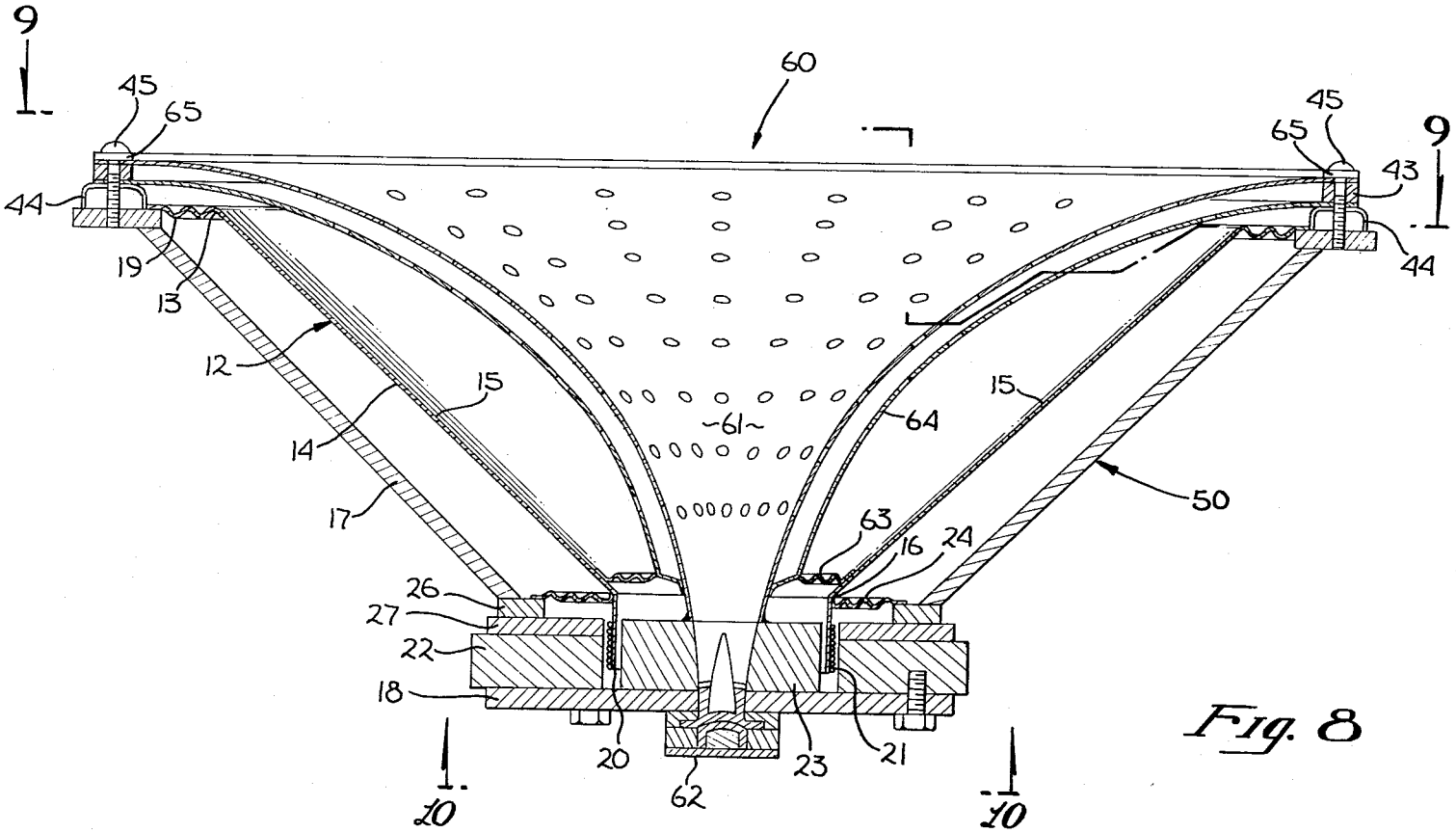
FIG. 8 is an elevational cross-sectional view of a coaxial loudspeaker which incorporates a third embodiment of an acoustic filter which is constructed in accordance with the principles of the present invention.

Referring now to FIG. 8 in conjunction with FIG. 9 a third embodiment of the present invention is an acoustic filter for use in combination with still another coaxial loudspeaker system which includes the second low frequency loudspeaker 50 and a third high frequency loudspeaker 60 having first horn 61, a transducer element 62 and circuitry for electronically directing the high frequency signals to the high frequency loudspeaker 60 and the low frequency signals to the low frequency loudspeaker 50 in order to provide a smooth crossover between them. The high frequency loudspeaker 60 is disposed in front of the low frequency loudspeaker 50 and axially aligned therewith and its transducer element 62 is mechanically coupled to the pole piece 23 of the low frequency loudspeaker 50. The low frequency loudspeaker 50 also includes a centering spider 63 which mechanically couples the diaphragm 12 of the low frequency loudspeaker 50 to a second horn 64 which is concentrically disposed within the first horn 61 of the high frequency loudspeaker 60.

Referring still to FIG. 8 in conjunction with FIG. 9 the improved acoustic filter includes the first horn 61 and the second horn 64, which are formed from a perforated sheet, both of which are separated a suitable distance by a first spacer 43, and a second spacer 44 which separates the second perforated horn 64 from the peripheral edge of the frame 17. A set of screws 45 secures the first and second perforated horns 61 and 64 and the first and second spacers 43 and 44 between a ring 65 and the frame 17 in order to enclose the airspace between the first and second perforated concentrically disposed horns 61 and 64 and to maintain the second horn 64 apart from the front peripheral edge of the conically shaped diaphragm 12, the peripheral edge of the frame 17 and the surround 19. The improved acoustic filter is placed between the low frequency loudspeaker 50 and the high frequency loudspeaker 60, which is mechanically coupled to the low frequency loudspeaker 50 through the pole piece 23 thereof, in order to either eliminate or inhibit the high frequency sounds from the high frequency loudspeaker 60 from interacting with the internal sidewall 15 of the conically shaped diaphragm 12 of the low frequency loudspeaker 50 thereby creating a Doppler shift in frequency which results in the distortion of the high frequency sounds.

Referring to FIG. 10 in conjunction with FIG. 8 the back plate 18 of the low frequency loudspeaker 50 is more clearly seen.

Figure 11:
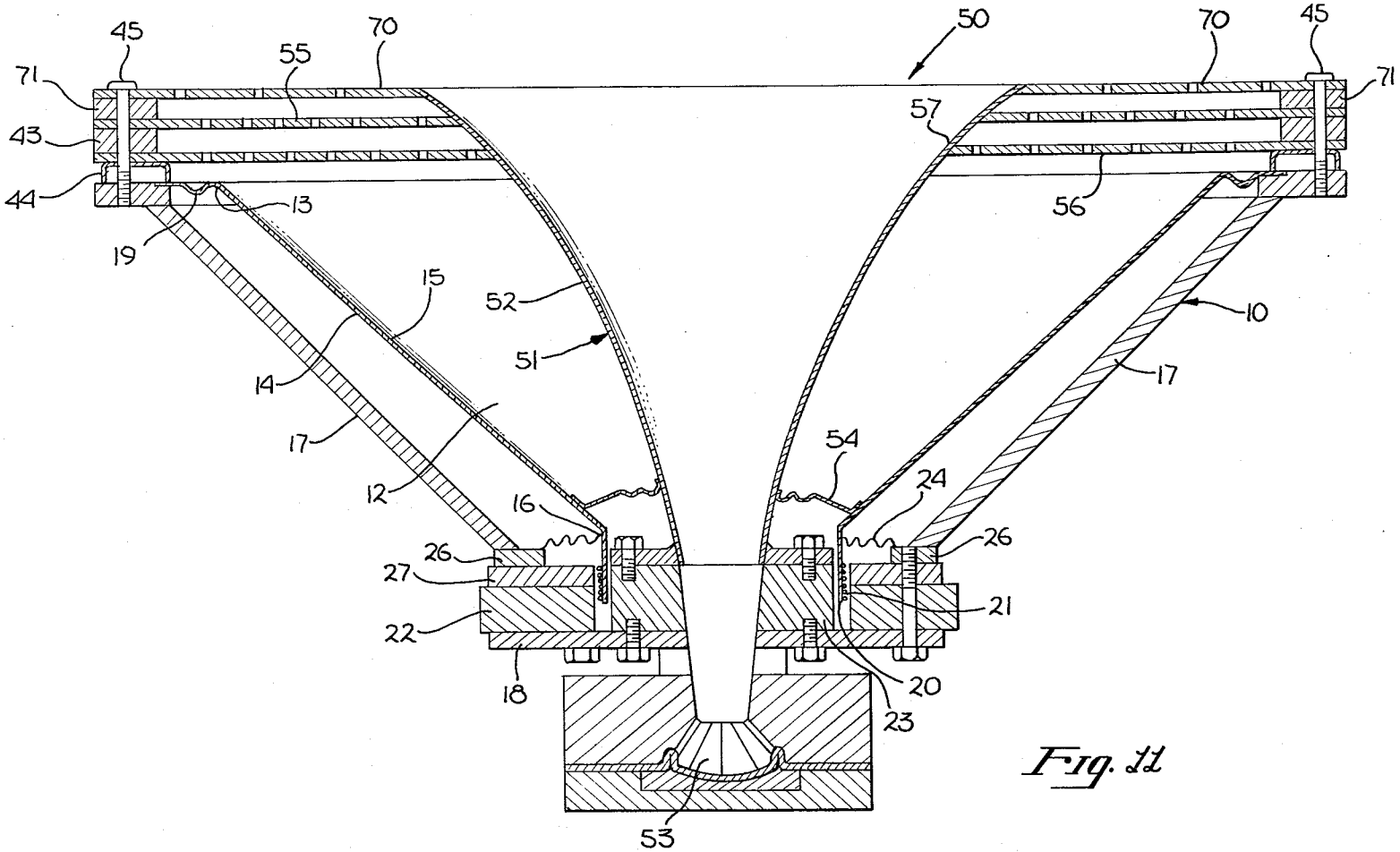
FIG. 11 is an elevational cross-sectional view of a coaxial loudspeaker system which incorporates a third perforated sheet, resulting in a two section acoustic filter which is constructed in accordance with the present invention.

Referring now to FIG. 11 a fourth embodiment of the present invention is an acoustic filter for use in combination with still another coaxial loudspeaker system. The improved acoustic filter includes a first perforated sheet 55, a second perforated sheet 56, which is parallelly disposed to the first perforated sheet 55 and is separated apart therefrom a suitable distance by the first spacer 43 and the second spacer 44 which separates the second perforated sheet 56 from the peripheral edge of the frame 17. The improved acoustic filter also includes a third perforated sheet 70 which is also parallelly disposed to the first perforated sheet 55 and is separated apart therefrom a suitable distance by a third spacer 71. The improved acoustic filter is placed between the low frequency loudspeaker 50 and the high frequency loudspeaker 51.

From the foregoing it can be seen that an improved acoustic filter for use in combination with a coaxial loudspeaker system has been described. The primary advantage of this combination is either the elimination of or the attenuation in the distortion of high frequency sounds resulting from the interaction between the sounds of the high frequency loudspeaker and the low frequency loudspeaker.

Accordingly, it is intended that the foregoing disclosure and showing made in the drawing shall be considered only as an illustration of the present invention. Furthermore it should be noted that the sketches are not drawn to scale and that distances of and between the various figures are not to be considered significant. The invention will be set forth with particularity in the appended claims.

What is claimed:

1. An acoustic filter for use in combination with a coaxial loudspeaker system which includes:

a. a conically shaped diaphragm of a low frequency loudspeaker having a front peripheral edge, an external sidewall, an internal sidewall and a base peripheral edge;

b. a cylindrically shaped voice coil member which is mechanically coupled to the diaphragm adjacent to its peripheral edge;

c. a voice coil mechanically coupled to the voice coil member;

d. a ring-shaped magnet disposed about the voice coil member;

e. a pole piece disposed within the voice coil member with the ring-shaped magnet and the pole piece creating a magnetic gap therebetween;

f. a frame that includes a conically shaped portion with an internal sidewall which receives the conically shaped diaphragm and a base portion which receives the ring-shaped magnet, the voice coil member and the pole piece;

g. a centering spider which mechanically couples the base portion of the frame to the base peripheral edge of the diaphragm; and h. a high frequency loudspeaker disposed in front of the conically shaped diaphragm, said acoustic filter comprising:

a. a pair of parallel perforated sheets which are separated from each other a suitable distance and which are joined together at their peripheries in any appropriate manner so that they enclose an airspace therebetween in order to form a single section acoustic filter.

2. An acoustic filter according to claim 1 wherein said acoustic filter also comprises:

a. third perforated sheet which is disposed parallelly to said pair of sheets and separated a suitable distance from one of said pair of sheets to which it is joined at their peripheries in any appropriate manner so that they enclose an airspace therebetween in order to form a double section filter.

3. An acoustic filter according to claim 1 wherein said pair of perforated sheets are disposed between the conically shaped diaphragm adjacent to its front peripheral edge and the high frequency loudspeaker so that said acoustic filter inhibits the high frequency sounds of the high frequency loudspeaker from interacting with the internal sidewall of the conically shaped diaphragm.

4. An acoustic filter according to claim 3 wherein the high frequency loudspeaker is mechanically coupled to said pair of perforated sheets.

5. An acoustic filter according to claim 3 wherein the high frequency loudspeaker is a horn loudspeaker which is mechanically coupled to the pole piece and disposed in front of said acoustic filter.

6. An acoustic filter for use in combination with a multiple sound transducing system which comprises:

a. first transducing means for generating low frequency sounds; in response to electrical input;

b. second transducing means for generating high frequency sounds in response to electrical input disposed in front of said first transducing means; and c. a pair of spaced perforated sheets which are separated from each other a suitable distance and which are joined together at their peripheries in any appropriate manner so that they enclose an airspace therebetween to form an acoustic filter, said pair of spaced perforated sheets are disposed between said first transducing means and said second transducing means so that said acoustic filter inhibits the high frequency sounds of the second transducing means from interacting with said first transducing means.

7. An acoustic filter in combination with a high frequency loudspeaker for use with a coaxial loudspeaker system which includes:

a. a conically shaped diaphragm of a low frequency loudspeaker having a front peripheral edge, an external sidewall, an internal sidewall and a base peripheral edge;

b. a cylindrically shaped voice coil member which is mechanically coupled to the diaphragm adjacent to its base peripheral edge;

c. a voice coil member mechanically coupled to the voice coil member;

d. a ring-shaped magnet disposed about the voice coil member;

e. a pole piece disposed within the voice coil member with the ring-shaped magnet and the pole piece creating a magnetic gap therebetween;

f. a frame that includes a conically shaped portion with an internal sidewall which receives the conically shaped diaphragm and a base portion which receives the ring-shaped magnet, the voice coil member and pole piece; and g. a centering spider which mechanically couples the base portion of the frame to the base peripheral edge of the diaphragm, wherein said high frequency loudspeaker and said acoustic filter comprise:

a. transducer means for providing an acoustic signal mechanically coupled to the pole piece;

b. a horn having a front peripheral edge and a base peripheral edge, said horn being formed by a pair of spaced perforated sheets which are separated from each other a suitable distance and which are joined together at their peripheries in any appropriate manner so that they enclose an airspace therebetween in order to form a single section acoustic filter so that said pair of perforated sheets are disposed in front of the conically shaped diaphragm adjacent to the front peripheral edge of the conically shaped diaphragm so that said acoustic filter inhibits the high frequency sounds of said high frequency loudspeaker from interacting with the internal sidewall of the conically shaped diaphragm.

8. An acoustic filter according to claim 7 wherein said acoustic filter also comprises:

a. a third perforated sheet which is formed in the shape of a horn with said horn being disposed concentrically therein a suitable distance apart therefrom.

* * * * *